US010331060B2

(12) United States Patent
Kawajiri

(10) Patent No.: US 10,331,060 B2
(45) Date of Patent: Jun. 25, 2019

(54) IMAGE FORMING APPARATUS CAPABLE OF PREVENTING UNNECESSARY REPLACEMENT OF TONER CARTRIDGE, METHOD OF CONTROLLING THE SAME, AND STORAGE MEDIUM

(71) Applicant: CANON KABUSHIKI KAISHA, Tokyo (JP)

(72) Inventor: Kensuke Kawajiri, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/916,787

(22) Filed: Mar. 9, 2018

(65) Prior Publication Data

US 2018/0267428 A1 Sep. 20, 2018

(30) Foreign Application Priority Data

Mar. 14, 2017 (JP) ..... 2017-048821

(51) Int. Cl.
*G03G 15/00* (2006.01)
*G03G 15/08* (2006.01)
*G03G 21/18* (2006.01)

(52) U.S. Cl.
CPC ..... *G03G 15/0863* (2013.01); *G03G 15/5016* (2013.01); *G03G 15/553* (2013.01);
(Continued)

(58) Field of Classification Search
CPC .. G03G 15/0863; G03G 15/55; G03G 15/553; G03G 15/556; G03G 15/751;
(Continued)

(56) References Cited

U.S. PATENT DOCUMENTS 5,805,956 A * 9/1998 Kawai ..... G03G 15/0266 399/46
2001/0015824 A1* 8/2001 Maeda ..... H04N 1/00002 358/1.15

(Continued)

FOREIGN PATENT DOCUMENTS

JP H1052964 A 2/1998
JP 2766046 B2 * 6/1998
JP 2013097069 A 5/2013

OTHER PUBLICATIONS

Machine translation of JP 2766046 B2 (published on Jun. 18, 1998) printed on Sep. 5, 2018.*

(Continued)

*Primary Examiner* — Sophia S Chen
(74) *Attorney, Agent, or Firm* — Rossi, Kimms & McDowell LLP

(57) ABSTRACT

An image forming apparatus capable of preventing unnecessary replacement of a toner cartridge when a drum part is replaced. The toner cartridge supplies toner. The drum part uses the toner supplied from the toner cartridge as lubricant when the drum part performs a first time operation after it has been mounted. The toner cartridge and the drum part are removably mounted. The image forming apparatus detects a value indicative of the remaining amount of toner stored in the toner cartridge and a value indicative of the remaining lifetime of the drum part. When the value indicative of the remaining lifetime is not larger than a predetermined threshold value, replacement of the drum part is notified. Contents of the notification are changed according to the value indicative of the remaining amount of toner stored in the toner cartridge.

23 Claims, 7 Drawing Sheets

(52) U.S. Cl.
CPC ..... *G03G 15/556* (2013.01); *G03G 15/751* (2013.01); *G03G 21/1889* (2013.01); *G03G 2215/0697* (2013.01)

(58) Field of Classification Search
CPC ..... G03G 21/1889; G03G 2215/0697; G03G 2221/1663; G03G 15/5016
See application file for complete search history.

(56) References Cited

U.S. PATENT DOCUMENTS

| | | | | |
|---|---|---|---|---|
| 2011/0207043 | A1* | 8/2011 | Yanagawa | C09B 47/04 430/69 |
| 2011/0293295 | A1* | 12/2011 | Shinohara | G03G 15/553 399/24 |
| 2012/0027424 | A1* | 2/2012 | Kawai | G03G 15/556 399/12 |
| 2013/0039667 | A1* | 2/2013 | Osawa | G03G 15/0863 399/12 |
| 2013/0108282 | A1 | 5/2013 | Sonoda et al. | |
| 2015/0268627 | A1 | 9/2015 | Yokota et al. | |
| 2016/0247047 | A1 | 8/2016 | Shirasaka | |
| 2016/0313685 | A1 | 10/2016 | Yamana | |

OTHER PUBLICATIONS

Decision to Grant and Search Report issued in Russian Appln. No. 2018108803 dated Mar. 13, 2019. English translation provided.

* cited by examiner

*FIG. 4A*

401

Time for replacing drum is approaching.
When performing replacement, replace drum and toner cartridge at the same time.

*FIG. 4B*

402

Time for replacing drum is approaching.

*FIG. 4C*

403

Time for replacing toner cartridge is approaching.

*FIG. 4D*

404

Time for replacing toner cartridge is imminent.

*FIG. 7*

| STATE OF DRUM PART | STATE OF TONER PART | REPLACEMENT DISPLAY FLAG | STATE OF DISPLAY |
|---|---|---|---|
| NOT LARGER THAN 20% | LARGER THAN 20% | OFF | MESSAGE 402 |
| NOT LARGER THAN 20% | NOT LARGER THAN 20% | OFF | MESSAGES 402, 403 |
| NOT LARGER THAN 20% | NOT LARGER THAN 10% | OFF | MESSAGES 402, 404 |
| NOT LARGER THAN 10% | LARGER THAN 20% | OFF | MESSAGE 402 |
| NOT LARGER THAN 10% | NOT LARGER THAN 20% | OFF | MESSAGES 402, 403 |
| NOT LARGER THAN 10% | NOT LARGER THAN 10% | OFF | MESSAGES 401, 404 |
| NOT LARGER THAN 20% | LARGER THAN 20% | ON | MESSAGE 402 |
| NOT LARGER THAN 20% | NOT LARGER THAN 20% | ON | MESSAGES 402, 403 |
| NOT LARGER THAN 20% | NOT LARGER THAN 10% | ON | MESSAGES 402, 404 |
| NOT LARGER THAN 10% | LARGER THAN 20% | ON | MESSAGE 401 |
| NOT LARGER THAN 10% | NOT LARGER THAN 20% | ON | MESSAGES 401, 403 |
| NOT LARGER THAN 10% | NOT LARGER THAN 10% | ON | MESSAGES 401, 404 |

IMAGE FORMING APPARATUS CAPABLE OF PREVENTING UNNECESSARY REPLACEMENT OF TONER CARTRIDGE, METHOD OF CONTROLLING THE SAME, AND STORAGE MEDIUM

BACKGROUND OF THE INVENTION

Field of the Invention

The present invention relates to an image forming apparatus, a method of controlling the same, and a storage medium, and more particularly to an image forming apparatus that includes a plurality of consumable parts, a method of controlling the same, and a storage medium.

Description of the Related Art

There has been known an MFP as an image forming apparatus that includes a plurality of consumable parts, such as a photosensitive drum, a developing device, and toner cartridges. For the MFP, each consumable part is configured to be removably mounted, and a user can replace each consumable part separately (see e.g. Japanese Laid-Open Patent Publication (Kokai) No. 2013-97069). In the MFP constructed as above, the remaining lifetime of each consumable part is notified based on the amount of usage of the consumable part (see e.g. Japanese Laid-Open Patent Publication (Kokai) No. H10-52964). This makes it possible for the user to be easily aware of a time for replacing the consumable part.

Incidentally, in the MFP, in a case where the photosensitive drum or the developing device (hereinafter referred to as the "drum part") is replaced by a new drum part and then a first time operation of the new drum part is performed, toner supplied from the toner cartridge is used as lubricant for the first time operation. In the MFP, it is preferable that the toner cartridge as well is simultaneously replaced when the drum part is replaced, in order to prevent the lubricant for the first time operation from becoming insufficient.

However, if the user is compelled to replace the toner cartridge as well in all cases of replacing the drum part, there can be a case where even though the toner cartridge has a sufficient amount of toner remaining therein, it is replaced by the user. That is, the conventional MFP has a problem that a toner cartridge which is not required to be replaced is sometimes replaced when a drum part is replaced.

SUMMARY OF THE INVENTION

The present invention provides an image forming apparatus that is capable of preventing unnecessary replacement of a toner cartridge when a drum part is replaced, a method of controlling the same, and a storage medium.

In a first aspect of the invention, there is provided an image forming apparatus on which a toner member for supplying toner, and another member that uses the toner supplied from the toner member as lubricant when the other member performs a first time operation after being mounted, are removably mounted, comprising an acquisition unit configured to acquire a value indicative of a remaining amount of toner stored in the toner member and a value indicative of a remaining lifetime of the other member, and a notification unit configured to provide a notification relevant to replacement of the other member when the value indicative of the remaining lifetime of the other member is not larger than a predetermined threshold value, wherein the notification unit switches contents of the notification according to the value indicative of the remaining amount of toner stored in the toner member.

In a second aspect of the invention, there is provided a method of controlling an image forming apparatus on which a toner member for supplying toner, and another member that uses the toner supplied from the toner member as lubricant when the other member performs a first time operation after being mounted, are removably mounted, comprising acquiring a value indicative of a remaining amount of toner stored in the toner member and a value indicative of a remaining lifetime of the other member, and providing a notification relevant to replacement of the other member when the value indicative of the remaining lifetime of the other member is not larger than a predetermined threshold value, wherein said providing the notification includes switching contents of the notification according to the value indicative of the remaining amount of toner stored in the toner member.

In a third aspect of the invention, there is provided a non-transitory computer-readable storage medium storing a computer-executable program for executing a method of controlling an image forming apparatus on which a toner member for supplying toner, and another member that uses the toner supplied from the toner member as lubricant when the other member performs a first time operation after being mounted, are removably mounted, wherein the method comprises acquiring a value indicative of a remaining amount of toner stored in the toner member and a value indicative of a remaining lifetime of the other member, and providing a notification relevant to replacement of the other member when the value indicative of the remaining lifetime of the other member is not larger than a predetermined threshold value, wherein said providing the notification includes switching contents of the notification according to the value indicative of the remaining amount of toner stored in the toner member.

According to the present invention, it is possible to prevent unnecessary replacement of a toner member (toner cartridge) when a drum part is replaced.

Further features of the present invention will become apparent from the following description of exemplary embodiments (with reference to the attached drawings).

BRIEF DESCRIPTION OF THE DRAWINGS

FIGS. 4A to 4D are views of examples of messages displayed on a console section appearing in FIG. 1.

FIG. 7 is a view of contents of notifications given according to remaining lifetime values of a toner part appearing in FIG. 2.

DESCRIPTION OF THE EMBODIMENTS

The present invention will now be described in detail below with reference to the accompanying drawings showing embodiments thereof.

Figure 1:
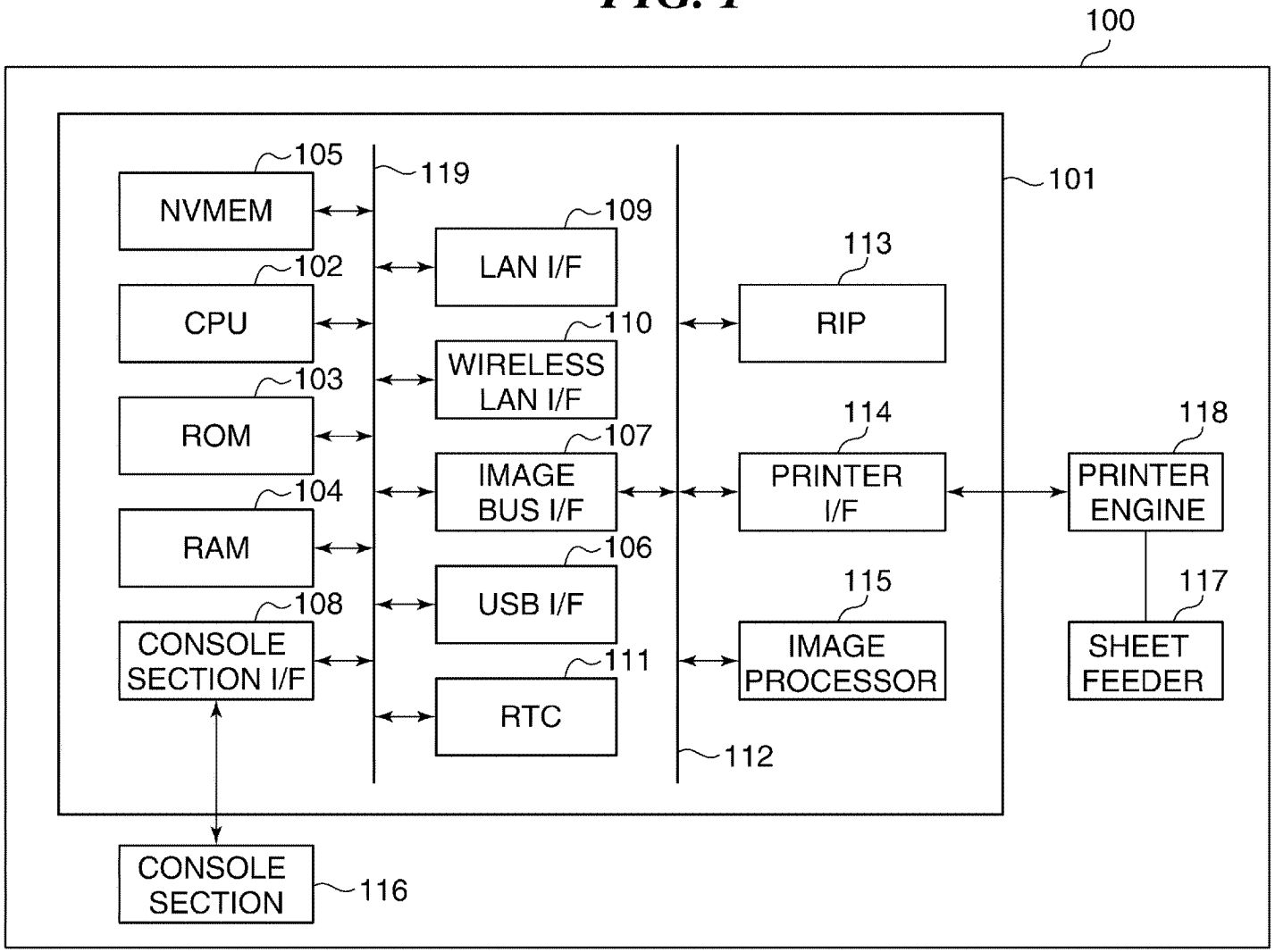
FIG. 1 is a schematic block diagram of an MFP as an image forming apparatus according to an embodiment of the present invention.

FIG. 1 is a schematic block diagram of an MFP (Multi-Function Peripheral) 100 as an image forming apparatus according to an embodiment of the present invention.

Referring to FIG. 1, the MFP 100 includes a controller unit 101, a console section 116, a sheet feeder 117, and a printer engine 118. The controller unit 101 is connected to the console section 116 and the printer engine 118, and the sheet feeder 117 is connected to the printer engine 118. The controller unit 101 is comprised of a CPU 102, a ROM 103, a RAM 104, an NVMEM 105, a USB interface 106, an image bus interface 107, a console section interface 108, a LAN interface 109, a wireless LAN interface 110, and a RTC (Real Time Clock) 111. Further, the controller unit 101 includes a RIP 113, a printer interface 114, and an image processor 115. The CPU 102, the ROM 103, the RAM 104, the NVMEM 105, the USB interface 106, the image bus interface 107, the console section interface 108, the LAN interface 109, the wireless LAN interface 110, and the RTC 111 are connected to each other via a system bus 119. The image bus interface 107, the RIP 113, the printer interface 114, and the image processor 115 are connected to each other via an image bus 112.

The controller unit 101 controls the overall operation of the MFP 100. The CPU 102 executes programs stored in the ROM 103 and the like to thereby perform various kinds of processing. The ROM 103 is a rewritable nonvolatile memory, and stores the programs and the like executed by the CPU 102. The RAM 104 is used as a work area for the CPU 102. Further, the RAM 104 is used as an area for temporarily storing various data. The NVMEM (Non-Volatile Memory) 105 stores setting information and the like. The USB interface 106 performs data communication with USB devices, such as USB memories, connected to USB terminals (not shown) of the MFP 100.

The image bus interface 107 is a bus bridge that connects between the system bus 119 and the image bus 112, and converts data structure. The console section interface 108 performs data communication with the console section 116. For example, the console section interface 108 acquires information input by a user's operation on the console section 116, from the console section 116. Further, the console section interface 108 receives from the CPU 102 a display control signal for performing display control of the console section 116, and delivers the display control signal to the console section 116. With this, screens for configuring various settings of the MFP 100, messages and the like are displayed on the console section 116. The LAN interface 109 performs wired LAN communication with external apparatuses connected thereto via a LAN cable, not shown. The wireless LAN interface 110 performs wireless communication with external apparatuses which can perform wireless LAN communication. The RTC 111 is a real time clock that functions as a clock for the MFP 100. The RTC 111 includes a battery, not shown, and continues its operation even when the MFP 100 is in a power-off state.

The image bus 112 is formed by a PCI bus or an IEEE 1394, and transfers image data at a high speed. The RIP (Raster Image Processor) 113 rasterizes vector data, such as a PDL code, into a bitmap image. The printer interface 114 performs data communication with the printer engine 118, and performs checking of a state thereof, and synchronous-to-asynchronous or asynchronous-to-synchronous conversion of image data. For example, the printer interface 114 transmits image data to the printer engine 118. Further, the printer interface 114 acquires respective remaining lifetime values of a drum part 201 and a toner part 202, described hereinafter with reference to FIG. 2, and outputs the acquired remaining lifetime values to the CPU 102. The image processor 115 corrects, manipulates, and edits received image data. Further, the image processor 115 performs resolution conversion and the like on image data to be output.

The console section 116 includes a plurality of keys, not shown, and a display section, not shown, for operating the MFP 100. For example, the console section 116 displays messages 401 to 404, described hereinafter with reference to FIGS. 4A to 4D. The sheet feeder 117 stores recording sheets, and feeds them to the printer engine 118 for performing printing. The printer engine 118 performs printing on the recording sheets based on image data acquired from the printer interface 114.

Figure 2:
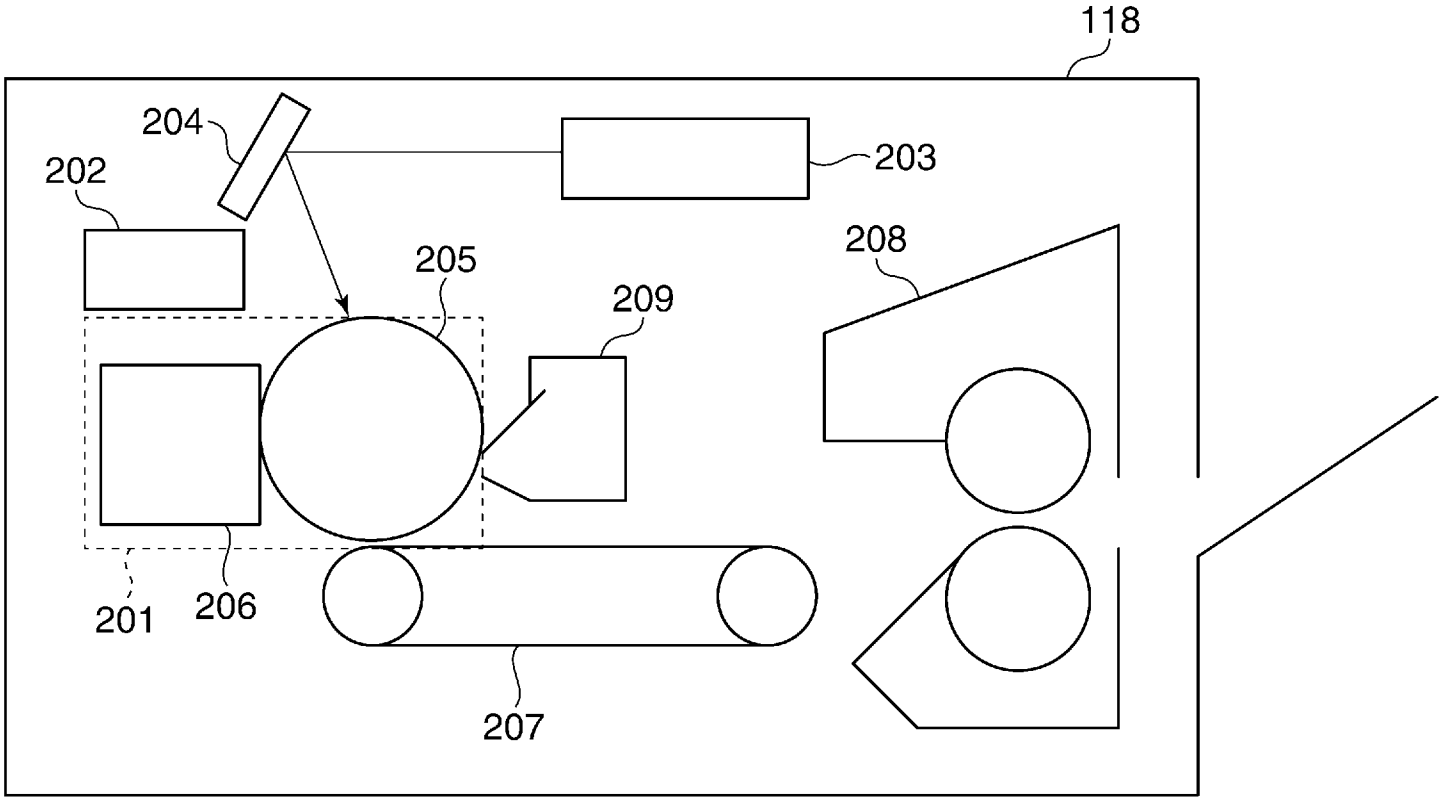
FIG. 2 is a schematic cross-sectional view of a printer engine appearing in FIG. 1.

FIG. 2 is a schematic cross-sectional view of the printer engine 118 appearing in FIG. 1.

Referring to FIG. 2, the printer engine 118 includes the drum part 201, the toner part 202 (toner member, i.e. toner cartridge), a solid-state laser device 203, a rotary polygon mirror 204, a transfer device 207, a fixing device 208, and a cleaner 209. The drum part 201 is comprised of a photosensitive drum 205 and a developing device 206.

The drum part 201, which is an integral-type consumable part including the photosensitive drum 205 and the developing device 206, is configured to be removably mounted, and the replacement thereof can be performed by the user. The MFP 100 calculates the remaining lifetime of the drum part 201 based on the number of rotations of the photosensitive drum 205. Whenever the photosensitive drum 205 rotates a predetermined number of times, a value indicative of the remaining lifetime (hereinafter referred to as the "remaining lifetime value") of the drum part 201 is reduced from 100% by a unit of 1%. In the MFP 100, when a first time operation of a new drum part 201 is performed after mounting the same, toner supplied from the toner part 202 is used as lubricant for the operation of internal components of the new drum part 201.

The toner part 202, which is a consumable part that supplies toner to the drum part 201, is configured to be removably mounted, and the replacement thereof can be performed by the user. The MFP 100 calculates a value indicative of the remaining amount of toner in the toner part 202 (hereinafter referred to as the "remaining lifetime value of the toner part 202"). In the present embodiment, a description will be given of an example in which the remaining lifetime value of the toner part 202 is expressed in three stages, i.e. a stage in which the remaining lifetime value is not larger than 10% (third stage), a stage in which the remaining lifetime value is larger than 10% and also not larger than 20% (second stage), and a stage in which the remaining lifetime value is 21% to 100% (first stage). The values of the respective stages are given only by way of example. Further, the remaining lifetime value of the toner part 202 may be managed by using a number of stages larger than the three stages. It is only required that the user can distinguish at least between a stage in which replacement of the toner part is required (the third stage), a stage in which preparation for replacement of the toner part is required since the time for the replacement is approaching (the second stage), and a state in which a sufficient amount of toner remains (the first stage).

The solid-state laser device 203 includes a light emitting element, not shown, and irradiates light onto the rotary polygon mirror 204. The rotary polygon mirror 204 rotates at a high speed, and scans the light irradiated from the solid-state laser device 203, to thereby irradiate the light onto a surface of the photosensitive drum 205. The surface of the photosensitive drum 205 is charged to a predetermined potential, and an electrostatic latent image is formed on the surface of the photosensitive drum 205 based on the light irradiated by the rotary polygon mirror 204. The developing device 206 accommodates two-component developer composed of toner particles and carrier particles, and develops the electrostatic latent image formed on the surface of the photosensitive drum 205 using the two-component developer. The toner particles and the carrier particles are supplied from the toner part 202 to the developing device 206. The transfer device 207 electrostatically transfers a toner image formed on the photosensitive drum 205 to a recording sheet conveyed from the sheet feeder 117. The recording sheet having the toner image electrostatically transferred thereon is conveyed to the fixing device 208, and the fixing device 208 thermally fixes the toner image on the recording sheet. After the toner image has been transferred to the recording sheet, the cleaner 209 cleans toner remaining on the photosensitive drum 205.

In the MFP 100, before the drum part 201 and the toner part 202 reach their lifetime limits, more specifically, in the case where the respective remaining lifetime values of the drum part 201 and the toner part 202 are not larger than 10%, a notification for prompting replacement of the drum part 201 and the toner part 202 with new ones is provided. In a case where the MFP 100 provides a notification relevant to replacement of the drum part 201 which uses toner supplied from the toner part 202 as lubricant when performing a first time operation after replacement, the notification is provided so as to prompt replacement of both the drum part 201 and the toner part 202 (simultaneous replacement) so as to prevent the lubricant from becoming insufficient. However, assuming that the user is compelled to replace the drum part 201 and the toner part 202 at the same time in all cases of replacing the drum part 201, even the toner part 202 which has a sufficient amount of toner remaining therein is replaced by the user. That is, this causes a problem that the toner part 202 which is not required to be replaced is replaced when the drum part 201 is replaced.

To overcome this problem, in the present embodiment, in the case where the MFP 100 provides the notification relevant to replacement of the drum part 201 when the remaining lifetime value of the drum part 201 is not larger than 10% (not larger than a predetermined threshold value), the MFP 100 switches contents of the notification according to the remaining lifetime value of the toner part 202. The predetermined threshold value of the drum part 201 is set to 10%, by way of example, and may be set to any other suitable value. Further, the predetermined threshold value may not necessarily be a value represented by a ratio. For example, it may be determined whether or not the remaining lifetime value is not larger than the predetermined threshold value, by using the number of rotations of the drum, the number of printed sheets, or the like.

Figure 3:
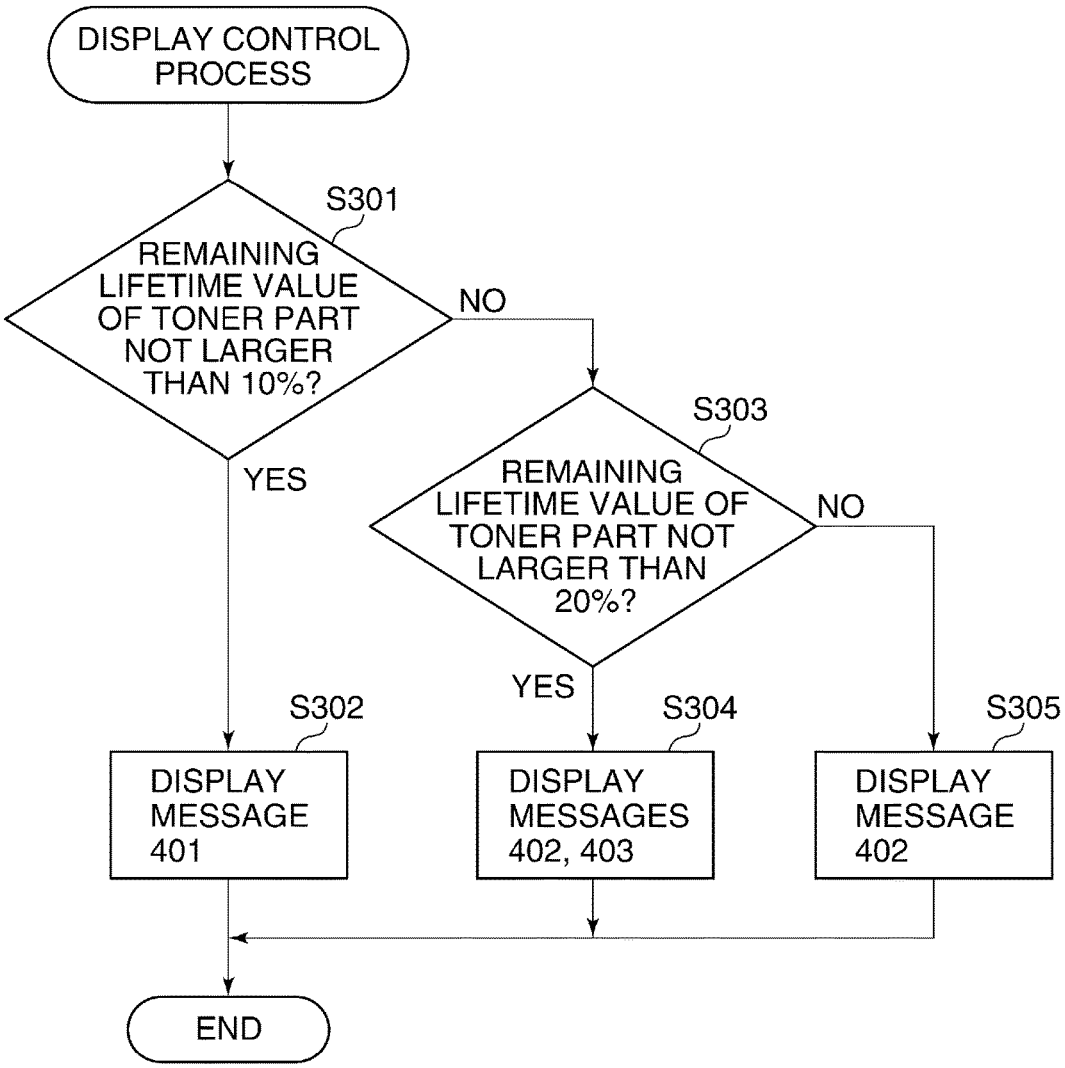
FIG. 3 is a flowchart of a display control process performed by the MFP shown in FIG. 1.

FIG. 3 is a flowchart of a display control process performed by the MFP 100 shown in FIG. 1. Hereinafter, with reference to FIG. 3, a description will be given of the display control process in which when the time for replacing the drum part 201 is approaching, contents of the notification to be displayed on the console section 116 are made different according to the remaining amount of toner in the toner part 202 (the remaining lifetime of the toner part 202).

As described above, when the drum part 201 is replaced with a new drum part 201, toner as lubricant is required. Here, assuming that only the drum part 201 is replaced in a state in which the remaining amount of toner in the toner part 202 is small (e.g. not larger than 10%), the toner used as lubricant may become insufficient, or even if the toner may be sufficient for the first time operation of the drum part, the toner part 202 reaches its lifetime limit soon. To solve this problem, when the expiration of the lifetime of the drum part 201 is approaching, the remaining lifetime of the toner part 202 as well is checked. Then, in a case where the expiration of the remaining lifetime of the toner part 202 is also approaching, the user is prompted to replace both the drum part 201 and the toner part 202 with new ones.

On the other hand, when the expiration of the lifetime of the drum part 201 is approaching in a case where a value indicative of the remaining amount of toner stored in the toner part 202 is not smaller than the threshold value, a message indicating the time for replacing the toner part 202 is approaching is displayed.

The display control process in FIG. 3 is performed by the CPU 102 executing an associated program stored in the ROM 103 or the like. The display control process in FIG. 3 is executed in a case where the CPU 102 acquires the remaining lifetime value of the drum part 201, which is not larger than 10%, from the printer interface 114.

Referring to FIG. 3, first, the CPU 102 acquires the remaining lifetime value of the toner part 202 from the printer interface 114, and determines whether or not the acquired remaining lifetime value of the toner part 202 is not larger than 10% (step S301).

If it is determined in the step S301 that the remaining lifetime value of the toner part 202 is not larger than 10%, the CPU 102 displays on the console section 116 the message 401 shown in FIG. 4A, which prompts replacement of both the drum part 201 and the toner part 202 (step S302). Note that in the present embodiment, in addition to the message 401, the message 404 shown in FIG. 4D, which suggests the necessity of replacement of the toner part 202, may be displayed. After executing the step S302, the CPU 102 terminates the present process.

If it is determined in the step S301 that the remaining lifetime value of the toner part 202 is larger than 10%, the CPU 102 determines whether or not the remaining lifetime value of the toner part 202 is not larger than 20% (step S303).

If it is determined in the step S303 that the remaining lifetime value of the toner part 202 is not larger than 20%, the CPU 102 alternately displays the message 402 shown in FIG. 4B and the message 403 shown in FIG. 4C at predetermined time intervals on the console section 116 (step S304). The message 402 indicates that the time for replacing the drum part 201 is approaching, and the message 403 indicates that the time for replacing the toner part 202 is approaching. After executing the step S304, the CPU 102 terminates the present process.

If it is determined in the step S303 that the remaining lifetime value of the toner part 202 is larger than 20%, the CPU 102 displays the message 402 on the console section 116 (step S305), followed by terminating the present process.

According to the display control process described above with reference to FIG. 3, when the MFP 100 provides a notification relevant to replacement of the drum part 201 of which the remaining lifetime value is not larger than 10% (not larger than the predetermined threshold value), the MFP 100 switches contents of the notification according to the remaining lifetime value of the toner part 202. That is, the notification relevant to replacement of the drum part 201 is not provided by the message 401 alone which prompts simultaneous replacement of the drum part 201 and the toner part 202. Therefore, it is possible to prevent the user from being excessively prompted to replace both the drum part 201 and the toner part 202 when the drum part 201 is replaced, and hence it is possible to prevent unnecessary replacement of the toner part 202 when the drum part 201 is replaced.

Further, in the display control process described above with reference to FIG. 3, in a case where the remaining lifetime value of the drum part 201 is not larger than 10%, and also the remaining lifetime value of the toner part 202 is larger than 10% and also not larger than 20%, the messages 402 and 403 are alternately displayed at the predetermined time intervals on the console section 116. Here, in the case where the remaining lifetime value of the toner part 202 is larger than 10% and also not larger than 20%, it is expected that soon afterwards the remaining lifetime value of the toner part 202 becomes not larger than 10%. From a viewpoint of efficient replacement of components, it is preferable that the drum part 201 and the toner part 202 are simultaneously replaced after the remaining lifetime value of the toner part 202 has become not larger than 10%. For this reason, before the remaining lifetime value of the toner part 202 becomes not larger than 10%, it is preferable to provide such a notification as will indicate that the time for replacing the drum part 201 and the toner part 202 is approaching, instead of prompting replacement of the drum part 201 and the toner part 202. In view of this, in the present embodiment, in the case where the remaining lifetime value of the drum part 201 is not larger than 10%, and also the remaining lifetime value of the toner part 202 is larger than 10% and also not larger than 20%, the messages 402 and 403 are alternately displayed at the predetermined time intervals on the console section 116. This makes it possible to positively notify the user that the time for replacing the drum part 201 and the toner part 202 is approaching although there is no need to replace them at once.

Furthermore, in the display control process described above with reference to FIG. 3, in a case where the remaining lifetime value of the drum part 201 is not larger than 10%, and also the remaining lifetime value of the toner part 202 is larger than 20%, only the message 402 is displayed on the console section 116. That is, in this case, the message 403 is not displayed on the console section 116. Here, in the case where the remaining lifetime value of the toner part 202 is larger than 20%, it is supposed that a necessary and sufficient amount of toner as lubricant for a first time operation of a new drum part 201 remains in the toner part 202. In this case, there is no need to replace the toner part 202 at once, and therefore a notification for replacement of the toner part 202, for example, the message 403 is not required to be displayed on the console section 116. In view of this, in the present embodiment, in the case where the remaining lifetime value of the drum part 201 is not larger than 10%, and also the remaining lifetime value of the toner part 202 is larger than 20%, the message 403 is not displayed on the console section 116. This makes it possible to avoid confusion of the user caused by an unnecessary notification relevant to replacement of the toner part 202.

In the display control process described above with reference to FIG. 3, in a case where the remaining lifetime value of the drum part 201 and that of the toner part 202 are both not larger than 10%, the message 401 for prompting simultaneous replacement of the drum part 201 and the toner part 202 is displayed on the console section 116. With this, in timing at which the drum part 201 and the toner part 202 are required to be replaced at the same time, it is possible provide a notification thereof by a message with appropriate contents.

Further, in the display control process described above with reference to FIG. 3, the drum part 201 is an integral-type member including the photosensitive drum 205 and the developing device 206. Therefore, for replacement of the drum part 201 that uses toner supplied from the toner part 202 as lubricant for a first time operation thereof after replacement, it is possible provide a notification by a message with appropriate contents.

Although the description has been given of the present invention based on the above-described embodiment, the present invention is not limited to the above-described embodiment. For example, in the case where the remaining lifetime value of the drum part 201 is not larger than 10%, and also the remaining lifetime value of the toner part 202 is larger than 20%, a message prompting replacement of only the drum part 201 may be displayed on the console section 116. This makes it possible to prompt the user to replace only the drum part 201 required to be replaced, out of the drum part 201 and the toner part 202.

Further, in the above-described embodiment, the message 401 may be displayed on the console section 116 during a time period after both the remaining lifetime value of the drum part 201 and that of the toner part 202 were detected to be not larger than 10% and before the remaining lifetime value of the drum part 201 is detected to be larger than 20%.

Here, a case is assumed where when the message 401 is displayed on the console section 116, the user forgets to replace one of the drum part 201 and the toner part 202. For example, in a case where the user forgets to replace the toner part 202, a tone replacement display control process, not shown, which is performed independently of the display control process in FIG. 3, causes the message 404, shown in FIG. 4D, which suggests the necessity of replacement of the toner part 202, to be displayed on the console section 116. Therefore, when the drum part 201 and the toner part 202 are to be replaced at the same time, even in a case where the user forgets to replace the toner part 202, the user can be aware, before the toner part 202 reaches its lifetime limit, that it is required to replace the toner part 202 as well. On the other hand, in a case where the user forgets to replace the drum part 201, the step S305 is executed, whereby the message 402 shown in FIG. 4B is displayed on the console section 116. In this case, the drum part 201 reaches its lifetime limit before the remaining lifetime value of the toner part 202 is reduced from 100% to 10% or smaller to cause the message 401 to be displayed on the console section 116. For this reason, when the drum part 201 and the toner part 202 are to be replaced at the same time, if the user forgets to replace the drum part 201, the user cannot be aware that it is required to replace the drum part 201 as well, before the drum part 201 reaches its lifetime limit.

In view of the above inconvenience, in a variation of the present embodiment, the message 401 is displayed on the console section 116 during a time period after both the remaining lifetime value of the drum part 201 and that of the toner part 202 were detected to be not larger than 10% and before the remaining lifetime value of the drum part 201 is detected to be larger than 10%.

Figure 5:
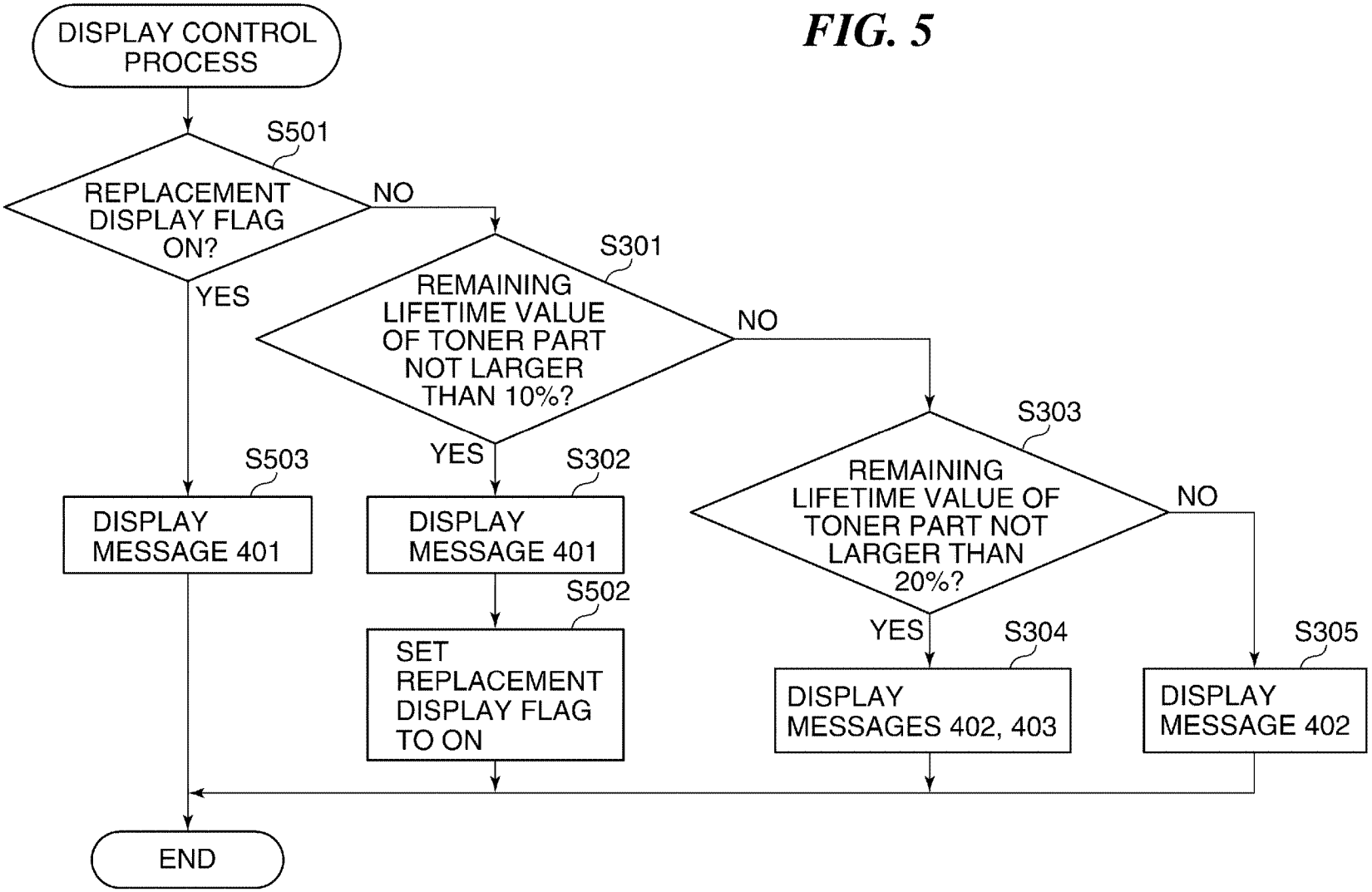
FIG. 5 is a flowchart of a variation of the display control process shown in FIG. 3, which is performed by a variation of the present embodiment.

FIG. 5 is a flowchart of a variation of the display control process shown in FIG. 3. In the example illustrated in FIG. 3, in a case where the remaining lifetime value of the drum part 201 is not larger than 10%, and also the remaining lifetime value of the toner part 202 is not larger than 10%, the message 401 prompting the user to replace both the drum part 201 and the toner part 202 is displayed. However, assuming that the user replaces only the toner part 202 without replacing the drum part 201, according to the display control process shown in FIG. 3, there are performed the following operations: Since the remaining lifetime value of the drum part 201 is not larger than 10%, and also the remaining lifetime value of the toner part 202 has become not smaller than 20%, the process proceeds to the step S305, wherein the message 402 is notified which indicates that the time for replacing the drum part 201 is approaching. However, in the above-described example, as a matter of fact, the remaining lifetime value of the drum part 201 is smaller than 10%, and originally, a message prompting replacement of the drum part 201 should be displayed. To this end, by executing the variation of the display control process in FIG. 5 and a flag control process in FIG. 6, the message 401 for prompting the user to replace both the drum part 201 and the toner part 202 is displayed, and thereafter the message 401 continues to be displayed until the drum part 201 is replaced, irrespective of the remaining lifetime value of the toner part 202. This message 401 is displayed for prompting the user to replace the drum part 201. As described above, it is possible to prompt the user to replace the drum part 201.

The display control process in FIG. 5 is performed by the CPU 102 executing an associated program stored in the ROM 303 or the like. The display control process in FIG. 5 is performed in a case where the CPU 102 has acquired from the printer interface 114 the remaining lifetime value of the drum part 201, which indicates that it is not larger than 10%.

Referring to FIG. 5, first, the CPU 102 determines whether or not a replacement display flag stored in the NVMEM 105 is on (step S501). The replacement display flag is set to either on or off. Normally, the replacement display flag is set to off, whereas in a case where both the remaining lifetime value of the drum part 201 and that of the toner part 202 are not larger than 10%, the replacement display flag is set to on.

If it is determined in the step S501 that the replacement display flag is not on, the CPU 102 executes the step S301.

If it is determined in the step S301 that the remaining lifetime value of the toner part 202 is not larger than 10%, the CPU 102 executes the step S302, and then sets the replacement display flag to on (step S502), followed by terminating the present process. On the other hand, if it is determined in the step S301 that the remaining lifetime value of the toner part 202 is larger than 10%, the CPU 102 executes the step S303 et seq.

If it is determined in the step S501 that the replacement display flag is on, the CPU 102 displays the message 401 on the console section 116 (step S503), followed by terminating the present process.

Figure 6:
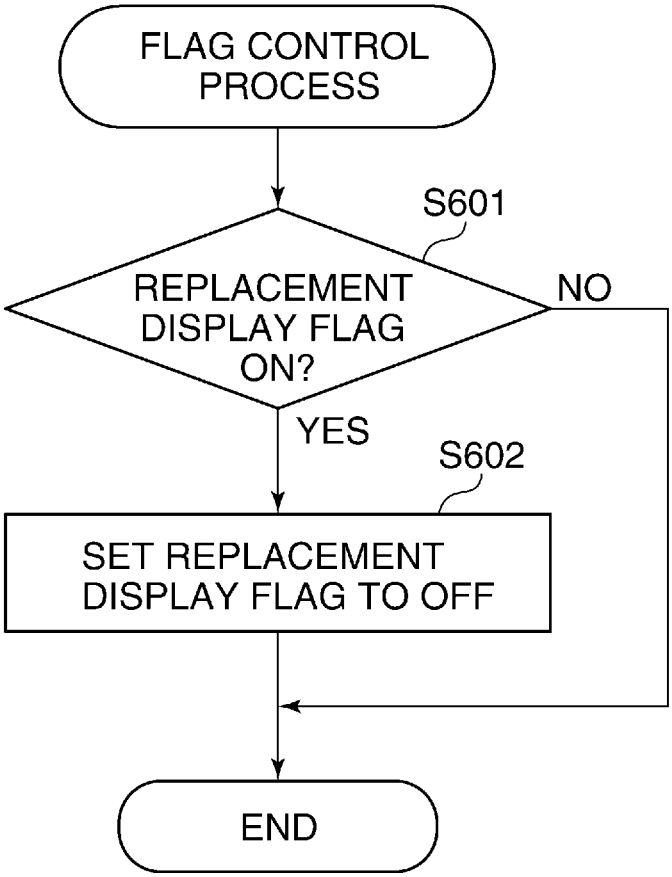
FIG. 6 is a flowchart of a flag control process performed by the variation of the present embodiment.

FIG. 6 is a flowchart of the flag control process performed by the MFP 100 shown in FIG. 1.

The flag control process in FIG. 6 is performed by the CPU 102 executing an associated program stored in the ROM 303 or the like. The flag control process in FIG. 6 is performed in a case where the CPU 102 has acquired from the printer interface 114 the remaining lifetime value of the drum part 201, which indicates that it is larger than 10%.

Referring to FIG. 6, first, the CPU 102 determines whether or not the replacement display flag is on (step S601).

If it is determined in the step S601 that the replacement display flag is not on, the CPU 102 terminates the present process. On the other hand, if it is determined in the step S601 that the replacement display flag is on, the CPU 102 sets the replacement display flag to off (step S602), followed by the CPU 102 terminating the present process. That is, in the variation of the present embodiment, the replacement display flag is set to on during a time period after both the remaining lifetime value of the drum part 201 and that of the toner part 202 were detected to be not larger than 10% and before the remaining lifetime value of the drum part 201 is detected to be larger than 10%. In the MFP 100, during a time period in which the replacement display flag is on, the message 401 is displayed on the console section 116.

By performing the flag control process described above with reference to FIG. 6, the display control process in FIG. 5 causes the message 401 to be displayed on the console section 116 during the time period after both the remaining lifetime value of the drum part 201 and that of the toner part 202 were detected to be not larger than 10% and before the remaining lifetime value of the drum part 201 is detected to be larger than 10%. That is, the message 401 is displayed on the console section 116 after the notification for prompting replacement of both the drum part 201 and the toner part 202 was provided and before the drum part 201 is replaced. With this, in timing at which the drum part 201 and the toner part 202 should be replaced at the same time, even if the user forgets to replace the drum part 201, it is possible to cause the user to be aware, before the drum part 201 reaches its lifetime limit, that it is required to replace the drum part 201 as well.

In the above-described embodiment, during the time period in which the replacement display flag is on, not only the message 401 but also any other suitable message may be displayed on the console section 116 according to the remaining lifetime value of the toner part 202. For example, as shown in FIG. 7, in the case where the remaining lifetime value of the toner part 202 is larger than 10% and also not larger than 20%, not only the message 401 but the message 403 is displayed on the console section 116. Further, in the case where the remaining lifetime value of the toner part 202 is not larger than 10%, not only the message 401 but also the message 404 is displayed on the console section 116. With this, during the time period in which the replacement display flag is on, it is possible provide a notification relevant to replacement of the toner part 202 by a message with appropriate contents, according to the remaining lifetime value of the toner part 202.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-048821 filed Mar. 14, 2017 which is hereby incorporated by reference herein in its entirety.

What is claimed is:

1. An image forming apparatus, on which a toner supplying unit for supplying toner and a driving unit that conveys the toner supplied by the toner supplying unit, are removably mounted, comprising:

a notification device which notifies a user of information; and at least one controller configured to function as:

a unit configured to acquire remaining information related to a remaining amount of toner stored in the toner supplying unit;

a unit configured to acquire lifetime information related to lifetime of the driving unit; and a unit configured to cause the notification device to perform a notification, wherein based on a fact that the lifetime information satisfies a first condition and the remaining information satisfies a second condition, the notification device notifies the user of information for indicating that a time for exchange of the driving unit is approaching together with information for prompting the user to exchange the driving unit, and wherein based on a fact that the lifetime information satisfies the first condition and the remaining information does not satisfy the second condition, the notification device notifies the user of information for indicating that the time for exchange of the driving unit is approaching without the information for prompting the user to exchange the driving unit.

2. The image forming apparatus according to claim 1, wherein the notification device is a display device, and the information notified by the notification device is displayed on the display device as a notification screen for prompting the user to exchange the driving unit.

3. The image forming apparatus according to claim 2, wherein the information notified by the notification screen further includes an information for prompting the user to exchange the toner supplying unit.

4. The image forming apparatus according to claim 2, wherein the information notified by the notification screen includes an information for prompting the user to exchange the driving unit and exchange the toner supplying unit at the same time.

5. The image forming apparatus according to claim 1, wherein the at least one controller, based on a fact that the lifetime information satisfies a third condition, causes the notification device to notify the user of information for indicating that a time for exchange of the driving unit is approaching, and, based on a fact that the lifetime information does not satisfy the third condition, does not cause the notification device to notify the user of the information for indicating that the time for exchange of the driving unit is approaching, and wherein the third condition encompasses the first condition.

6. The image forming apparatus according to claim 1, wherein the at least one controller causes the notification device to notify the user of information for indicating that a time for exchanging the toner supplying unit is approaching based on a fact that the lifetime information does not satisfy the first condition and the remaining information satisfies the second condition.

7. The image forming apparatus according to claim 1, wherein the driving unit includes a photosensitive drum.

8. The image forming apparatus according to claim 1, wherein the driving unit includes a developing device.

9. The image forming apparatus according to claim 1, wherein a predetermined toner supplying processing for lubricating a drive of the driving unit is performed in accordance with a detection of a new driving unit mounted.

10. The image forming apparatus according to claim 1, wherein the first condition requires that a value held by the lifetime information is a predetermined value or lower.

11. The image forming apparatus according to claim 1, wherein the second condition requires that a value held by the remaining information is a predetermined value or lower.

12. The image forming apparatus according to claim 1, wherein the at least one controller stops the notification performed by the notification device based on a detection of a new driving unit mounted.

13. The image forming apparatus according to claim 1, wherein the at least one controller, based on a fact that the remaining information satisfies a fourth condition, causes the notification device to notify the user of information for indicating that a time for exchange of the toner supplying unit is approaching, and, based on a fact that the remaining information does not satisfy the fourth condition, does not cause the notification device to notify the user of the information for indicating that a time for exchange of the toner supplying unit is approaching, and wherein the fourth condition encompasses the second condition.

14. The image forming apparatus according to claim 1, wherein after the notification for prompting the user to exchange the driving unit, the at least one controller causes the notification device to perform the notification for prompting the user to exchange the driving unit again in a case where the toner supplying unit has been exchanged and the driving unit has not been exchanged.

15. A control method of an image forming apparatus, having a notification device which notifies a user of information, and on which a toner supplying unit for supplying toner and a driving unit that conveys the toner supplied by the toner supplying unit, are removably mounted, the method comprising:

acquiring remaining information related to a remaining amount of toner stored in the toner supplying unit;

acquiring lifetime information related to lifetime of the driving unit; and causing the notification device to perform a notification, wherein based on a fact that the lifetime information satisfies a first condition and the remaining information satisfies a second condition, the notification device notifies the user of information for indicating that a time for exchange of the driving unit is approaching together with information for prompting the user to exchange the driving unit, and wherein based on a fact that the lifetime information satisfies the first condition and the remaining information does not satisfy the second condition, the notification device notifies the user of information for indicating that the time for exchange of the driving unit is approaching without the information for prompting the user to exchange the driving unit.

16. The control method according to claim 15, wherein the notification device is a display device, and the information notified by the notification device is displayed on the display device as a notification screen for prompting the user to exchange the driving unit.

17. The control method according to claim 16, wherein the information notified by the notification screen further includes an information for prompting the user to exchange the toner supplying unit.

18. The control method according to claim 16, wherein the information notified by the notification screen includes an information for prompting the user to exchange the driving unit and exchange the toner supplying unit at the same time.

19. The control method according to claim 15, wherein based on a fact that the lifetime information satisfies a third condition, causing the notification device to notify the user of information for indicating that a time for exchange of the driving unit is approaching, and, based on a fact that the lifetime information does not satisfy the third condition, not causing the notification device to notify the user of the information for indicating that the lifetime for exchange of the driving unit is approaching, and wherein the third condition encompasses the first condition.

20. The control method according to claim 15, wherein causing the notification device to notify the user of information for indicating that a time for exchanging the toner supplying unit is approaching based on a fact that the lifetime information does not satisfy the first condition and the remaining information satisfies the second condition.

21. The control method according to claim 15, wherein a predetermined toner supplying processing for lubricating a drive of the driving unit is performed in accordance with a detection of a new driving unit mounted.

22. The control method according to claim 15, wherein stopping the notification performed by the notification device based on a detection of a new driving unit mounted.

23. A non-transitory medium storing a program for the control method of an image forming apparatus, having a notification device which notifies a user of information, and on which a toner supplying unit for supplying toner and a driving unit that conveys the toner supplied by the toner supplying unit, are removably mounted, the method comprising:

acquiring remaining information related to a remaining amount of toner stored in the toner supplying unit;

acquiring lifetime information related to lifetime of the driving unit; and causing the notification device to perform a notification, wherein based on a fact that the lifetime information satisfies a first condition and the remaining information satisfies a second condition, the notification device notifies the user of information for indicating that a time for exchange of the driving unit is approaching together with information for prompting the user to exchange the driving unit, and wherein based on a fact that the lifetime information satisfies the first condition and the remaining information does not satisfy the second condition, the notification device notifies the user of information for indicating that the time for exchange of the driving unit is approaching without the information for prompting the user to exchange the driving unit.

* * * * *